US011013393B1

(12) United States Patent
Harrison

(10) Patent No.: US 11,013,393 B1
(45) Date of Patent: May 25, 2021

(54) CLOG PREVENTIVE FLOOR FINISH APPLICATOR

(71) Applicant: Olakunle Harrison, Montgomery, AL (US)

(72) Inventor: Olakunle Harrison, Montgomery, AL (US)

( * ) Notice: Subject to any disclaimer, the term of this patent is extended or adjusted under 35 U.S.C. 154(b) by 21 days.

(21) Appl. No.: 16/449,894

(22) Filed: Jun. 24, 2019

(51) Int. Cl.

| | |
|---|---|
| ***B43M 11/02*** | (2006.01) |
| ***A47L 13/22*** | (2006.01) |
| ***B05B 12/08*** | (2006.01) |
| ***A47L 13/312*** | (2006.01) |

(52) U.S. Cl.
CPC ..... *A47L 13/22* (2013.01); *A47L 13/312* (2013.01); *B05B 12/087* (2013.01)

(58) Field of Classification Search
CPC ..... A47L 13/22; A47L 13/312; B05B 12/087
USPC ..... 401/137–139
See application file for complete search history.

(56) References Cited

U.S. PATENT DOCUMENTS 6,550,998 B1 * 4/2003 Fernschild ..... A46B 11/063 401/270
10,478,038 B1 * 11/2019 Gardner ..... A47L 13/23

* cited by examiner

*Primary Examiner* — Jennifer C Chiang

(57) ABSTRACT

Discharge ports of liquid floor finish applicators are known to clog if proper steps are not taken immediately after use. Complicating this clogging problem are the facts that floor finishes are formulated to dry quickly when exposed to air and applicator cleaning creates waste and takes considerable time and effort. Accordingly, applicant's invention addresses the problem of clogging by using a liquid reservoir to enclose the applicator's discharge port thus preventing it from clogging when not in use. To illustrate applicant's invention, a backpack floor finish applicator system dispenses liquid floor finish through a hose and a pump that forces the finish through a nozzle onto the floor. The invention uses a non-contact switch that activates a light which alerts the operator when the nozzle is exposed to air which will cause clogging thereby reminding the operator to position the nozzle within the liquid reservoir when not in use.

20 Claims, 3 Drawing Sheets

CLOG PREVENTIVE FLOOR FINISH APPLICATOR

CROSS-REFERENCE TO RELATED APPLICATIONS

Not Applicable

BACKGROUND OF THE INVENTION

1 Field of the Invention

The present invention relates to a floor finish applicator for applying floor finish to a floor. More particularly, it relates to fields of applicators which have a tank and means for causing floor finish to be dispensed from the tank to the floor whereupon a fibrous mop pad is used to further distribute or smooth out the applied liquid.

2. Description of Related Art

Traditionally, the application of floor finish to floors has been done using the mop and bucket approach—a slow, laborious and environmentally unfriendly method. Floor finish applicators of the pull-behind type are disclosed in U.S. Pat. Nos. 2,979,756; 3,457,015; 3,981,596; 4,124,315; 4,471,713; 8,246,263. These applicators have the advantage of being able to cover large areas in shorter amounts of time than their manually operated wanded counterparts. However, the pull-behind applicators are bulky and lack the flexibility of being able to access tight corners or work around corners or obstructions. Additionally the pull-behind applicators taught in the aforementioned patents are complicated systems with numerous components. Manually operated wand-type floor finish applicators are disclosed in U.S. Pat. Nos. 4,152,084; 6,799,916; 8,782,843. Some of these wand-type applicators utilize a backpack tank for the floor finish. These manually operated wand-type applicators require considerable physical labor to apply floor finish, especially to large areas.

Floor finishes have the dominant characteristic of quickly drying very hard when exposed to ambient conditions. A shared characteristic of all these applicators, whether pull-behind or manual wand-type, is that they require a clean out procedure when the floor finishing task is completed to rid the applicator passages of floor finish which upon drying will clog the system thus requiring special, additional, intensive, time-consuming cleaning. In addition, the expensive and wasted floor finish resulting from flushing the apparatus ends up as an environmental pollutant.

Alternatively, some pull-behind applicator designs involve a separate holding tank containing a clean-out liquid such as water, additional valving and tubing, an auxiliary pump, and a switching mechanism to accomplish the clean-out process automatically or semi-automatically, usually at considerable additional cost of complexity and implementation.

The prior art does not provide for a floor finish applicator with a minimum number of parts which allows floor finish to be applied rapidly to very large areas such as is possible with pull-behind applicators and simultaneously to small areas with obstructions such as is possible with the wand-type applicators, requires no cleaning whatsoever after each use, and provides a visual indicator to the operator for clog preventive purposes.

BRIEF SUMMARY OF THE INVENTION

This invention permits a floor finish applicator to be used multiple times without flushing after each use with varying degrees of time duration between use minutes, hours, days, weeks, or even months, thus eliminating the time and effort required to clean up and store the applicator after it has been used. At the heart of the present invention is the discovery that the drying or coagulating of a liquid at a nozzle's discharge orifice is effectively obviated by isolating the discharge orifice in a liquid retaining reservoir when the applicator is not in use and providing visual indication to the user whenever the discharge orifice is not in its isolated position within the liquid retaining reservoir. A visual indication such as a light serves very well as a reminder to the user to retire the discharge orifice to the liquid retaining reservoir to prevent subsequent clogging when not in use, which for some liquids can begin to take place in as little as three minutes depending on ambient conditions. The activation of a visible light is made possible by a non-contact switching means adapted to this application wherein the liquid floor finish dries to a hard consistency on all surfaces it is in contact with.

The present invention relates to a floor finish applicator head for use in distributing floor finishes to a floor. Some embodiments feature a unique system for maintaining a clog-free liquid discharge orifice that allows for multiple application operations without the necessity of cleaning out the system to prevent the floor finish from drying out and clogging the liquid's exit orifice. This invention prevents the liquid discharge orifice of an applicator, whether of the spray type or the drip or non-spray type from drying out thus removing the need to empty and clean out the applicator's internal passages after each use. This invention provides a means of maintaining the function of an applicator's liquid floor finish discharge port by allowing the operator to open and close said discharge port without the possibility of the liquid floor finish drying out at the discharge orifice when not in use.

In waxing floors, the floor finish applicator components located in the vicinity of the spray head are usually covered by the spray mist generated by the applicator head during use.

Consequently, all exposed parts of the applicator device will receive an undesirable coating of the liquid being applied. Upon drying, all coated surfaces which are supposed to move relative to each other for function, if present, are likely to be stuck together unless they are thoroughly cleaned after use—an additional undesirable cleaning requirement. This invention takes this scenario into account by designing components and materials that will still perform their functions in such a hostile environment.

In one embodiment, a liquid retaining reservoir comprising a non-permeable container and a resilient non-permeable cap with a reclosable opening used to substantially contain and maintain a liquid-laden reservoir environment in which the liquid discharge orifice resides when not in use.

In one embodiment, a liquid-retaining open-celled foam material is used to hold a maintenance liquid in the vicinity of the liquid discharge orifice when it is not in use.

In one embodiment, a reversible screw motion action is used to move the liquid retaining reservoir and the cap with a reclosable opening to expose or conceal the liquid discharge orifice as needed for the applicator to perform its function.

An object of the invention is to provide a floor finish applicator that alerts the operator when the liquid floor finish discharge orifice is exposed to environmental conditions that will result in clogging at or around the orifice.

This invention provides a visual indicator by means of a visible light that serves as a reminder to the operator that the liquid floor finish discharge orifice is exposed to ambient atmospheric conditions that promote clogging thus preventing further use of the applicator head and necessitating a clean-out and unclogging procedure for removing dried out liquid floor finish from the applicator's flow passages.

One object of the invention is to provide a floor finish applicator that reduces the amount of labor necessary for applying floor finishes to areas large and small.

In one embodiment, the source of the floor finish is contained inside a backpack-style tank.

In another embodiment, the backpack tank contains a pump and a rechargeable battery for providing power to said pump. It is understood that the finish can also be supplied to the applying device by gravitational forces.

In another aspect, the delivery of liquid floor finish to the discharge orifice is made possible by the activation of a trigger valve.

In one embodiment, the liquid floor finish orifice is configured as a spray nozzle to broadly and quickly dispense liquid floor finish to the floor.

In yet another embodiment, the applicator head is attached to an applicator frame to which an applying device is attached for further spreading the liquid floor finish on the floor after spraying. The applying device is a pad with fibrous material which is stored in a substantially air tight container when not in use to prevent the evaporation of moisture from the working surface of said pad thereby causing drying and hardening of the pad surface. The pad can then be stored without the need for rinsing out the embedded liquid floor finish and thus can be reused immediately after removal from the substantially air tight container.

This invention provides a drip-free spray applicator suitable for maintaining the integrity of a just-waxed floor surface when the mop head and frame assembly is lifted off the floor surface. The mop head frame tilts upwards when the frame is lifted off the floor surface thereby preventing any liquid from dripping from the discharge orifice or from the liquid retaining reservoir proximate to the orifice orifice. A suitable seal is provided on the non-opening end of the reservoir to prevent dripping.

The present invention relates to applicators for applying floor finish to floors. More particularly, it relates to a simplified floor finish spray applicator head which utilizes a tank, a pump, and a clog preventing spray head that eliminates the need to clean out the applicator after each use.

BRIEF DESCRIPTION OF THE DRAWINGS

FIG. 1 is a perspective view of the floor finish applicator embodying aspects of this invention including a spray pattern and the direction of travel.

DETAILED DESCRIPTION OF PREFERRED EMBODIMENT

The present invention will now be described in detail with the understanding that the specific embodiments of the invention presented with reference to the drawings are merely and only illustrative of a small number of possible embodiments which simply represent a variety of applications of the principles that undergird the present invention.

The fundamental principle of the present invention which differentiates it from all of the prior art floor finish applicator assemblies discussed in the Description of Prior Art section is the use of a liquid retaining reservoir to prevent clogging and dripping in a floor finish applicator that does not require either cleaning out or generation of any waste in regular use along with a switching means and electronic circuitry that indicates by means of a light, the position of the applicator's discharge orifice during and after use.

Figure 1:
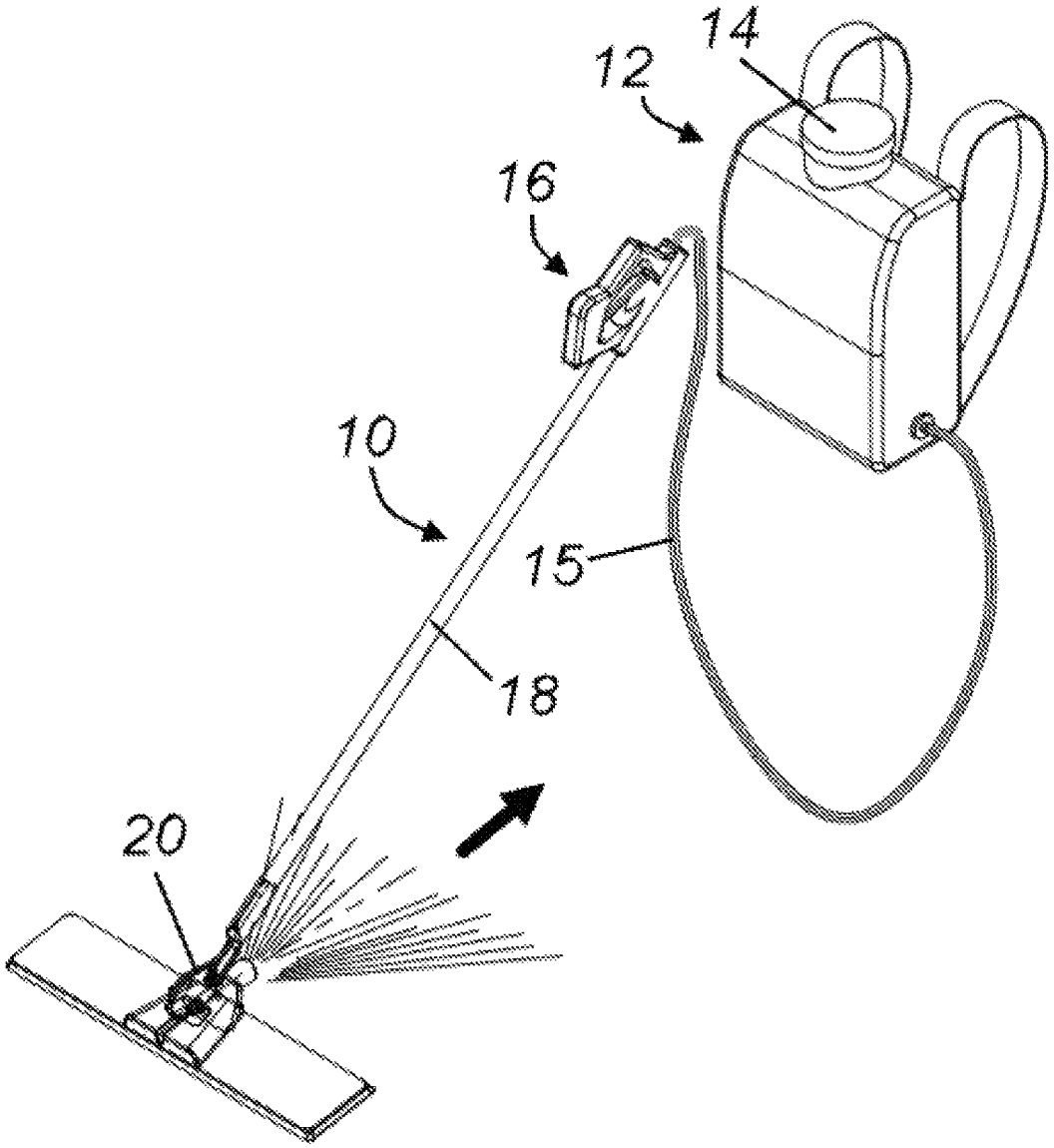
FIG. 1 Drawing of overall applicator tool comprising backpack with straps, conduits, trigger, elongated handle, applicator head, liquid retaining reservoir, applicator pad frame.

Referring now to FIG. 1 of the drawings, an illustrated view of an exemplary floor finish application tool 10 is presented. The pull-behind floor finish applicator is designed to quickly and effectively apply floor finish to a floor, in its preferred embodiment, using a powered fluid delivery system. In operation, the applicator provides maximum flexibility allowing i in tight corners, under and behind furniture as needed to apply floor finish in a variety of building facilities. The floor finish composition used within the applicator is compatible with the various parts of the applicator 10 with which the finish comes in contact. The preferred embodiment for the floor finish applicator 10 broadcasts floor finish onto a surface by means of a flat fan spray and uses a fibrous pad to further distribute the floor finish on the surface.

The illustrated floor finish applicator tool 10 comprises a floor finish holding tank 12 which in this embodiment is carried in a backpack fashion by the operator. The tank 12 has a removable cover 14 through which liquid floor finish is added by way of a removable strainer, not shown. The tank 12 has within it a pump and a rechargeable battery that provides power to said pump, not shown. An internal filter screen, not shown, ensures that clog-causing debris and congealed floor finish do not enter into the pump passages. The backpack tank 12 also has an on/off switch, not shown, which can be set in low or high rates, depending on the rate of delivery of floor finish desired.

The floor finish flows from the pump in the tank 12 through a conduit 15 to a hand-operated trigger gun 16 mounted at the proximal end of an elongated handle 18. The trigger gun 16 comprises a valve actuator lever and a valve, as well as a means for holding and manipulating the elongated handle 18. The elongated handle 18 is a hollow tube constructed of light weight material such as aluminum to reduce operator fatigue during use. By activating the trigger in the trigger gun 16, floor finish flows from the tank 12 to the conduit 15 through the trigger gun and into the conduit 20 which is contained within the hollow elongated handle 18.

Figure 2:
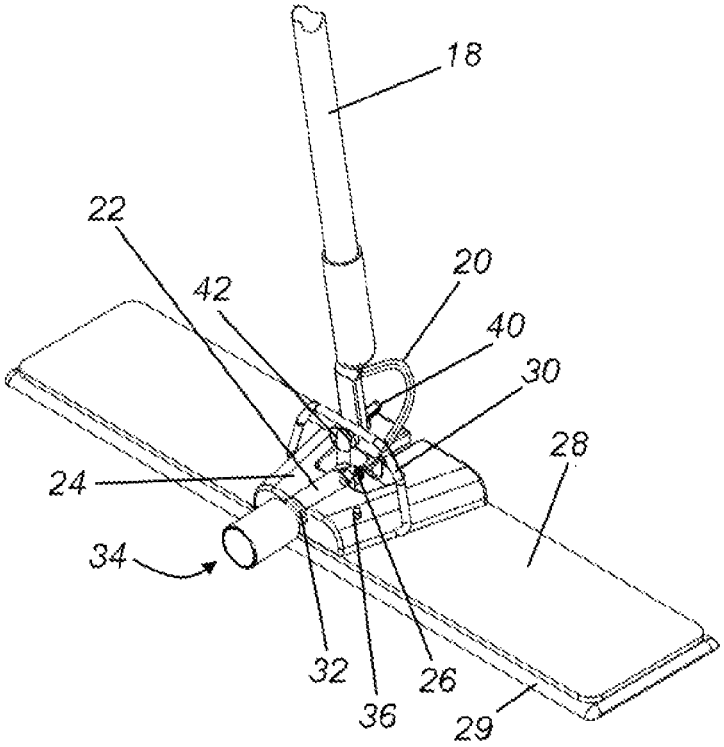
FIG. 2 shows more detail of the distal end of the elongated handle with its attachment to the applicator head and pad frame and the supply tubing that communicates floor finish flow to the applicator head. The view shows the articulation of the handle to the applicator head via a swiveling and pivoting bracket as well as the liquid retaining reservoir assembly at the posterior end of the applicator head.

Referring to FIG. 2, the conduit 20 directs flow to an internal passage 22 within the applicator head 24 by means of a quick-disconnect tube fitting 26. The applicator head 24 is attached to the applicator frame 28 which is made of a lightweight material such as aluminum to reduce operator fatigue while still exerting enough pressure on the fibrous applicator pad 29 which is mounted under the applicator frame 28 and is contact with the floor during use. In the preferred embodiment, a microfiber applicator pad 29 is employed using a hook and loop fastening method. Other types of applicator pad material such as wool and fastening systems can also be used in this tool. The applicator head 24 is attached to the bracket 30 which is connected to the distal end of handle 18. The bracket 30 provides connections that permit rotating and pivoting motion of the distal end of handle 18 relative to the applicator head 24 and the applicator frame 28. The applicator head further comprises a hollow threaded feeder tube 32 through which the floor finish flows to the discharge outlet. A person skilled in the art knows that more than one feeder tube in conjunction with a manifold can also be utilized in this application. A liquid retaining reservoir 34 is movably and rotatably attached to the threaded feeder tube 32. Further detailed description of the operation of the liquid retaining reservoir 34 and the threaded feeder tube 32 is forthcoming.

The handle 18 pivots in two principal directions, about a medial axis and about a lateral axis of the applicator frame. The pivoting of the handle 18 about these two principal axes provides great flexibility for a powered floor finish applicator allowing the operator to apply floor finish around corners, under furniture, and in any direction in the plane of the floor surface. The handle 18 is mounted to bracket 30 to allow for handle 18 to pivot about a medial axis. A desirable feature of the present invention is that the ease with which handle 18 pivots with respect to bracket 38 around the medial axis is controlled by the tightness of the nut 40 which couples handle 18 to bracket 38 using carriage bolt 42 and thus controls the friction between both components. The wing nut 40 in the preferred embodiment is one that the operator can easily tighten or loosen because of said wing nut's extents which facilitate the manual application of tightening torque using the operator's fingers and not a separate tool for that purpose. A further description of the method of operation and relevant internal components of the floor finish applicator will be forthcoming with subsequent references to other figures.

Figure 3:
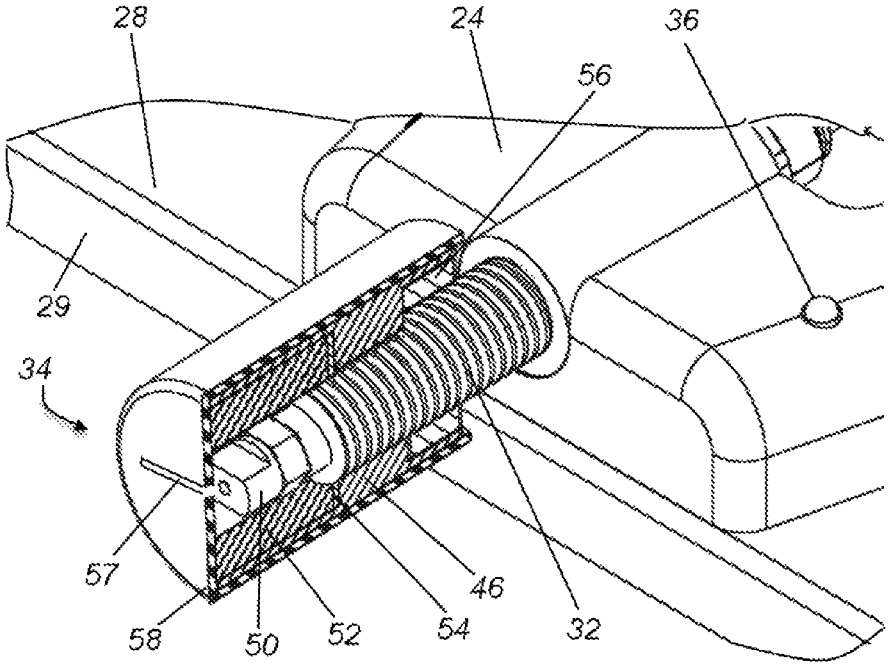
FIG. 3 is a section view of the liquid retaining reservoir assembly in the closed position indicating the internally threaded sleeve which houses a chamber within which is disposed an open-cell foam liquid retainer, a sealing washer, and a magnet for switching the tool's electronic circuit which controls the annunciator warning light. A rubber cap with a reclosable slit at its front encloses the liquid retainer with the non-permeable sleeve.
Figure 4:
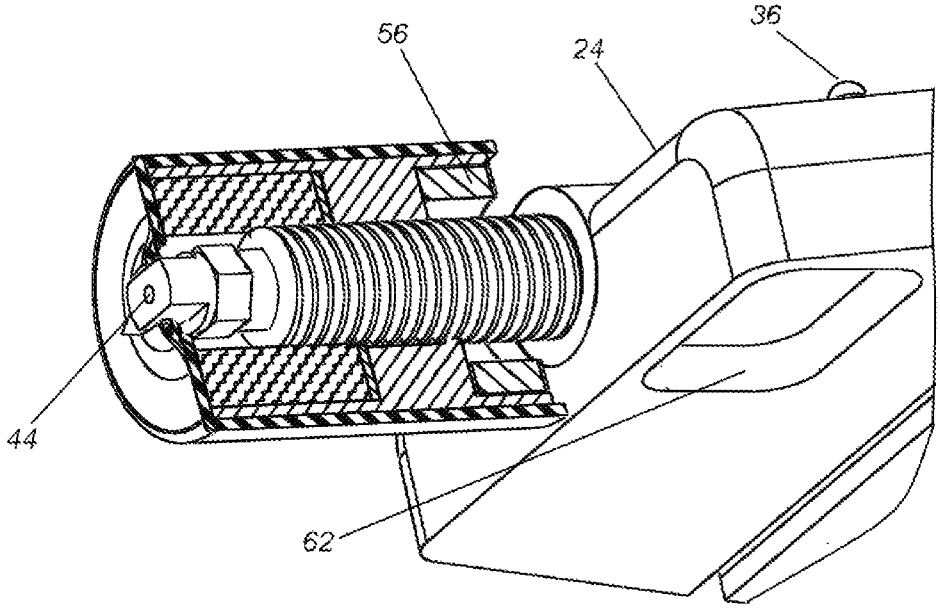
FIG. 4 shows the liquid retaining reservoir in its open position and its relationship to the housing for the electronic components located at the bottom of the applicator head.

In FIG. 3 and FIG. 4, greater detail of the arrangement of the discharging section of the applicator head 24 is facilitated. Referring to FIG. 3, the liquid retaining reservoir 34 shown in its functionally closed, nonworking position substantially encloses the discharge outlet 44 of the applicator head 24. The closed position is the storage position of the applicator tool 10 which prevents the discharge outlet 44 of the applicator head 24 from clogging. In FIG. 4 the liquid retaining reservoir 34 is in the functionally open position which exposes the tip of the discharge outlet, in this case the orifice of nozzle 50, to broadcast the liquid floor finish to the floor surface. The relative position of the liquid retaining reservoir 34 along the medial axis of the applicator head 24 controls the operation of the annunciator warning light 36. When the liquid retaining reservoir 34 is in a substantially closed position, the warning light 36 is off. When the liquid retaining reservoir 34 is in its substantially open position which allows floor finish to be broadcast to the floor surface, the warning light 36 is on thereby indicating to the operator that the discharge outlet 44 is exposed to environmental conditions that will cause clogging. The warning light 36 is an extremely effective measure that reminds the operator of the need to place the liquid retaining reservoir 34 in its closed position if the tool 10 will not be in use for three or more minutes which is about the time it takes for some floor finish compositions to begin to coagulate and cause clogging. In the preferred embodiment, the warning light 36 is configured to be a light emitting diode, red in color, and flashing at a frequency of about 2.5 Hz. A more in-depth description of the liquid retaining reservoir 34 and the warning light system will provide further insight.

The internal configuration of the liquid retaining reservoir 34 which exists to maintain a humid environment around the discharge outlet 44 of the floor finish applicator tool is illustrated in FIG. 3. By maintaining a humid environment around the discharge outlet 44, clog-causing coagulation of the floor finish at said discharge outlet 44 is prevented which allows the tool to be stored for days or even weeks when not in use without the requirement for flushing the entire applicator tool 10 before storage as found in most floor finish applicators in the prior art. In FIG. 4 the sleeve 46 is adapted with internal cylindrical threads 48 to operate as a nut in engagement with the external threads of the hollow threaded feeder tube 32 oriented in the general direction of the medial axis of the applicator head 24. In this preferred embodiment, the channel inside the hollow threaded feeder tube 32 is a conduit for liquid floor finish to reach the discharge nozzle orifice 50 from which the liquid floor finish is broadcast onto the floor surface at the discharge outlet 44. In FIG. 3 the discharge nozzle 50 is in the closed position within the humid environment of the liquid retaining reservoir 34 which contains a maintenance liquid such as tap water. The slit 57 in the rubber cap 58 allows for a re-closeable valve that is configured to accept a variety of discharge outlet configurations, one example of which is a discharge nozzle 50 as depicted in the preferred embodiment. To assist in retaining the liquid within the liquid retaining reservoir 34 and to prevent dripping of said liquid, a sponge or open-cell foam 52 is disposed within the liquid retaining reservoir 34 chamber. In its preferred embodiment, the foam 52 is annular and does not impede the movement of the sleeve 46 relative to the threaded feeder tube 32.

Referring again to FIG. 3, a washer-shaped seal 54 of a flexible nonbonding material such as silicone rubber is mounted at the anterior end of the sleeve 46 where its inner diameter is flexibly in continuous contact with the surfaces of at least one of the threads of the threaded feeder tube 32 thus providing a sealing function that prevents liquid floor finish from running out of the liquid retaining reservoir 34 and over the threads. The wiping action of washer-shaped seal 54 also effectively limits liquid floor finish build-up on the threaded feeder tube 32 which will impair the travel of the sleeve 46 as it moves against the thread surfaces. A non-stick coating such as Teflon® on the threaded feeder tube 32 also reduces the possibility of liquid floor finish buildup on threaded feeder tube 32.

Figure 5:
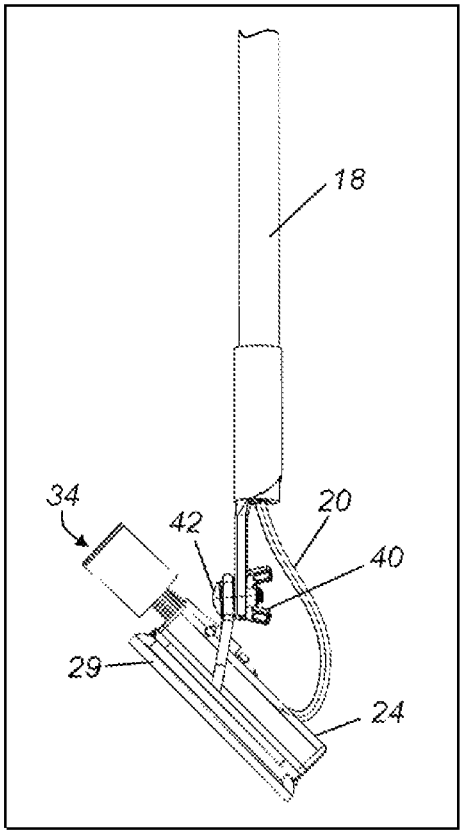
FIG. 5 shows the orientation of the applicator head, applicator frame, and applicator pad when lifted up away from the floor in the vertical direction.

The importance of keeping the liquid floor finish from running out of the liquid retaining reservoir 34 can be seen in FIG. 5 where in the present embodiment, the applicator frame 28 has been designed so that the front of the applicator head 24 tilts upward and away from the floor to prevent liquid floor finish from dripping onto the floor when the applicator tool 10 is lifted up away from the floor by the operator. In addition, shearing forces disposed on the helical thread surfaces when a torque is applied as the operator turns the liquid retaining reservoir 34 overcome the adhesive effect of congealed finish at the thread interfaces. Thus, the operator can override the sealing effect of the congealed floor finish liquid on the thread surfaces, if necessary.

Referring back to FIG. 3 and FIG. 4, on the posterior portion of the sleeve 46, an annular magnet 56 is disposed within the cylindrical pocket and rotates and translates with the liquid retaining reservoir 34 assembly. The magnet 56 produces a magnetic field as the liquid retaining reservoir 34 approaches the applicator head 24 at a predefined linear distance from the applicator head 24. As shown in FIG. 4 with the applicator frame and pad absent, the underside of the applicator head 24 is partially configured as a housing 62 for the applicator tool's electronic circuitry with switching means such as a reed switch and the annunciator warning light 36. Thus, a non-contact switching system that is impervious to the effects of coagulation and drying of liquid floor finish on all surfaces to which it comes in contact is afforded at very low cost. The location of the reed switch relative to the magnetic field is important and has been carefully chosen by analysis and experimentation to be approximately 0.75 in. laterally away from the medial axis of the applicator head 24 and at the proper linear distance from the limits of travel of the magnet 56. As a consequence of hysteresis in the operation of the reed switch, this arrangement is functionally robust because the warning light 36 comes on just as the slit in the rubber cap 58 is opening to expose the tip of the nozzle 50 and is delayed in turning off as the rubber cap 58 is being withdrawn from the reed switch to its closed position, thus ensuring a fully closed liquid retaining reservoir 34 before the warning light 36 turns off.

As a result of the use of a magnetic field for switching the warning light 36, it is necessary that adjacent components be constructed of nonferrous materials in order to reduce the size of the magnet needed to actuate the warning light 36. In the preferred embodiment, the applicator head 24 is made from plastic, and the threaded feeder tube 32 and the applicator frame 28 are made of aluminum.

In FIG. 3, the cap 58 made of a flexible material such as silicone rubber is disposed over the liquid retaining reservoir 34 and is configured with a reclosable opening at the anterior end of the liquid retaining reservoir 34. The reclosable opening of cap 58 allows the nozzle 50 to be exposed to the floor when the sleeve 46 has been sufficiently advanced toward the applicator head 24. In the preferred embodiment, the opening of cap 58 is a slit which, because of the cap's flexibility, closes off its opening when the nozzle 50 is withdrawn into the closed position for storage.

Referring to FIG. 3, the longitudinal axis of the discharge nozzle 50 is displaced at a slight angle from the horizontal. This angular displacement is necessary in order to deposit the proper amount of liquid floor finish on the floor. The angle of displacement has been found to be a function of multiple factors including the applicator pad 29 width, the nozzle's fan spray angle, the flow rate of the nozzle, the pump pressure delivered from the tank 12, the viscosity of the typical floor finish, and the walking speed of the operator. If the angle is too shallow, the liquid floor finish will be deposited over too wide a surface relative to the width of the applicator pad 29 and with too light a concentration. An angle that is too large will cause the liquid floor finish to unacceptably pool in front of the applicator pad 29 making it difficult for the applicator pad 29 to achieve an even distribution of liquid floor finish on the surface. The specific angle of displacement has been found from experimentation to be between 2 and 3 degrees with 2.5 degrees from the horizontal is considered optimum for both 24-inch wide and 36-inch wide applicator pad sizes.

The present invention combines the flexibility of a backpack floor finish applicator with the speed and coverage capability of a wheeled-cart applicator without the need to flush out the system after use. The operator is kept alert to detrimental exposure of the discharge outlet at all times. The tool can be used and reused at short notice with minimal preparation and can be placed in storage for hours, days, or weeks without the labor intensive process of ridding the tool of quick-to-coagulate floor finish.

Modifications and changes obvious to ones skilled in the art pertaining to the present invention are deemed to be within the spirit and scope of the present invention as further defined in the appended claims. Also, it is understood that the terminology and phraseology used herein is for the purpose of description should not be regarded as limited. Other alternate mechanical and electrical configurations are possible and fall within the spirit and scope of the present invention.

It should be understood that the foregoing description of this novel floor finish applicator tool is merely a representation of an exemplary embodiment of the present invention and that one skilled in the art can make various changes and modifications in the arrangement and details of construction of the described elements without departing from the spirit and scope of the present invention. Other possible embodiments of this invention can be used in the following applications wherein clogging can be problematic:

1 Hand-held paint spray guns
2 Robot-mounted spray guns
3 Agricultural & garden spraying applicators
4 Industrial spraying applicators
5 Pest control spraying applicators While preferred embodiments of the present invention have been illustrated and described in the foregoing detailed description, it is understood that there is no intent to limit the invention by such disclosure but instead the illustration and description are intended to cover all modifications and alternate constructions falling within the spirit and scope of the invention as set forth in the following claims.

Various features of the invention are set forth in the following claims.

What is claimed is:

1. A floor finish applicator comprising:

a liquid floor finish container with at least one opening;

at least one conduit connected to the liquid floor finish container, said conduit having a regulating valve to control the flow of liquid floor finish;

an applying device configured to hold at least one floor finish applicator pad;

a fluid dispensing body with at least one feeder comprising a feeder body, a discharge outlet, and a liquid retaining reservoir which, when the applicator is not in operation, isolates said feeder's discharge outlet from the environment that causes coagulation of liquid floor finish within and around said discharge outlet and reversibly exposes said discharge outlet to the environment to enable the application of the liquid floor finish to a floor surface;

an absorbent material positioned substantially within said liquid retaining reservoir and disposed about a retracted position of the discharge outlet when the applicator is not in use;

a means for activating indicia mounted on the liquid retaining reservoir that depends on the position of the discharge outlet relative to the liquid retaining reservoir;

indicia that indicates that the discharge outlet is not in the retracted position, said retracted position of said discharge outlet being substantially enclosed within the liquid retaining reservoir;

the conducting of the liquid floor finish from the liquid floor finish container to the discharge outlet or applying device is accomplished by either gravity or a pump.

2. The floor finish applicator of claim 1, wherein the liquid retaining reservoir comprises materials that possess low liquid vapor permeability.

3. The floor finish applicator of claim 1, wherein at least one end portion of said liquid retaining reservoir body has a re-closable opening through which the discharge outlet can be exposed to dispense the liquid floor finish to the floor surface or to an applying device, while the other portions of the liquid retaining reservoir provide a means for retaining moisture or liquid within said liquid retaining reservoir.

4. The floor finish applicator of claim 1, wherein the position of the liquid floor finish discharge outlet relative to the liquid retaining reservoir activates a visible light when said discharge outlet is open to ambient conditions that cause said liquid floor finish to coagulate, that is, when substantially outside the liquid retaining reservoir.

5. The floor finish applicator of claim 1, wherein said liquid retaining reservoir's position relative to the liquid discharge outlet is changed by rotating screw thread engagement action of said liquid retaining reservoir relative to the feeder body for the liquid floor finish thereby causing a shearing action that overcomes the bond between the mating surfaces of a predetermined number of contiguous screw threads caused by the drying of the exposed liquid floor finish on said thread surfaces.

6. The floor finish applicator of claim 5, wherein said liquid retaining reservoir has, on one end portion, a washer-shaped flexible material, such as silicone rubber, with an inner diameter as small as or smaller than the feeder tube's minor diameter so that said flexible material is substantially engaged in a sealing or cleaning function on the feeder body's exterior surface at the flexible material's inner diameter and a sealing function at and around its outer diameter thus substantially reducing the chances of evaporation of moisture from the liquid retaining reservoir and preventing leakage of liquid said reservoir onto and around said screw threads.

7. The floor finish applicator of claim 4, wherein a non-contact means is used to activate the light which communicates to the operator whether said at least one discharge outlet is in its closed position wherein it is isolated from the environment that facilitates coagulation of the liquid floor finish within said discharge outlet, or in its open position wherein the liquid floor finish can be discharged onto the floor or applying device.

8. The floor finish applicator of claim 7, wherein the indication of the position of the liquid floor finish's discharge outlet relative to the liquid retaining reservoir comprises a magnetically triggered electrical circuit for indicating said relative position of said discharge outlet, whether exposed to or isolated from ambient conditions that can cause coagulation of the liquid floor finish within said discharge outlet.

9. A floor finish applicator comprising:

a liquid floor finish container with at least one opening;

at least once conduit connected between the liquid floor finish container and a feeder with at least one discharge outlet for dispensing the liquid floor finish onto a floor, said at least one conduit having a regulating valve to control the flow of liquid floor finish;

an applying device comprising an applicator pad made of a fibrous material and mounted to a suitable frame in a pull-behind configuration to further smooth the liquid floor finish already dispensed on the floor;

an operator-controlled liquid retaining reservoir comprising a valve for preventing clogging of said discharge outlet wherein the discharge outlet can be moved from a retracted position substantially within said reservoir when not in use, to a protracted position which exposes said discharge outlet to the floor for dispensing the liquid floor finish onto the floor;

a sponge-like material capable of retaining a liquid, positioned substantially within said liquid retaining reservoir and disposed about the retracted position of the discharge outlet when the applicator is not dispensing liquid floor finish onto the floor or is not in operation;

an activation means disposed wholly or partially within the liquid retaining reservoir to indicate that the discharge outlet is exposed to ambient conditions that will cause liquid floor finish within said discharge outlet to congeal and clog up the discharge outlet when the discharge outlet is not dispensing floor finish;

indicia that communicates to the operator that the discharge outlet is not in the retracted position, said retracted position of said discharge outlet being one that substantially encloses said discharge outlet within said liquid retaining reservoir thus preventing coagulation of liquid floor finish within and around said discharge outlet when said discharge outlet is not dispensing floor finish;

the conducting of the liquid floor finish from the liquid floor finish container to the discharge orifice or applying device is accomplished by either gravity or a pump.

10. The floor finish applicator of claim 9, wherein the discharge outlet device is a spray nozzle with a discharge orifice.

11. The floor finish applicator of claim 9, wherein the liquid retaining reservoir valve for exposing or isolating the discharge outlet comprises a re-closable slit.

12. The floor finish applicator of claim 9, wherein the liquid retaining reservoir valve is made of rubber or similar resilient material.

13. The floor finish applicator of claim 9, wherein the liquid retaining reservoir is configured such that a maintenance liquid can be added to reduce the evaporation of liquid floor finish from and around the liquid discharge outlet.

14. The floor finish applicator of claim 9, wherein the posterior end of the liquid retaining reservoir has an opening that is adapted to seal around the feeder body thus preventing liquid floor finish from escaping from the posterior end of the liquid retaining reservoir.

15. The floor finish applicator of claim 9, wherein the liquid retaining reservoir is adapted with a switching means to activate a visible light when the discharge outlet is positioned substantially outside the liquid containing sponge portion of the liquid retaining reservoir.

16. The floor finish applicator of claim 9, wherein said discharge outlet body, in its protracted position, is urged against the liquid retaining reservoir valve resilient material at or around its slit to cause the discharge outlet to be exposed to the floor in order to dispense the liquid floor finish to the floor.

17. The floor finish applicator of claim 13, wherein said maintenance liquid is water which is added to the liquid retaining reservoir to increase the humidity within said liquid retaining reservoir and hinder evaporation of liquids within said reservoir.

18. The floor finish applicator of claim 9, wherein the indicia is at least one visible light in its on and off states, including a flashing light configuration.

19. The floor finish applicator of claim 9, wherein the applying device is configured such that, upon being lifted up from the floor, the applicator discharge outlet and the liquid retaining reservoir are tilted upwards away from the floor to prevent dripping of the contents of the liquid retaining reservoir onto the floor.

20. The floor finish applicator of claim 9, wherein a container is used for storing the applicator pad to substantially seal said applicator pad from outside air after use thus preventing the floor finish on or within said applicator pad from drying out and congealing, thus permitting said applicator pad to be reused without special treatment.

* * * * *